United States Patent [19]

Lukaszonas

[11] Patent Number: 4,709,506

[45] Date of Patent: Dec. 1, 1987

[54] SWIVEL SHUTTER ASSEMBLY

[76] Inventor: William S. Lukaszonas, 7525 Old Father Rd., Tucson, Ariz. 85741

[21] Appl. No.: 919,631

[22] Filed: Oct. 16, 1986

[51] Int. Cl.[4] ..... E06B 7/086

[52] U.S. Cl. ..... 49/88; 49/90; 49/92; 49/403; 98/121.2

[58] Field of Search ..... 49/88, 90, 92, 94, 74, 49/403; 98/121.2

[56] References Cited

U.S. PATENT DOCUMENTS

| | | | |
|---|---|---|---|
| 253,469 | 2/1882 | Young | 49/403 |
| 298,170 | 5/1884 | Botherton . | |
| 346,220 | 7/1886 | Radford . | |
| 534,076 | 2/1895 | McFarland | 49/88 |
| 1,551,753 | 9/1925 | Lane | 49/88 |
| 1,718,754 | 6/1929 | Molina | 98/121.2 X |
| 2,060,615 | 11/1936 | Ernst . | |
| 2,238,648 | 4/1941 | Kallio | 49/90 X |
| 2,324,454 | 7/1943 | Huff | 49/88 X |
| 2,513,250 | 6/1950 | Pettit | 49/403 |
| 2,558,362 | 6/1951 | Keene . | |
| 2,562,235 | 7/1951 | Greenberg . | |
| 2,607,090 | 8/1952 | Chartoff . | |
| 2,761,185 | 9/1956 | Sherwood . | |
| 2,789,792 | 4/1957 | Davis | 98/121.2 X |
| 2,799,061 | 7/1957 | Hadary | 49/74 |
| 3,123,189 | 3/1964 | Wiley | 49/92 X |
| 3,137,043 | 6/1964 | Moellner . | |
| 3,491,481 | 1/1970 | Wunderlick . | |
| 3,874,114 | 4/1975 | Rowell . | |
| 4,160,343 | 7/1979 | Hubbard | 49/90 |

FOREIGN PATENT DOCUMENTS

| | | | |
|---|---|---|---|
| 702712 | 2/1941 | Fed. Rep. of Germany | 49/88 |
| 206649 | 1/1940 | Switzerland | 49/90 |
| 392838 | 10/1965 | Switzerland | 49/88 |

*Primary Examiner*—Philip C. Kannan

*Attorney, Agent, or Firm*—J. Michael McClanahan

[57] ABSTRACT

A swivel shutter assembly providing a plurality of louvers rotationally held within a framework which presents, by ship-lap type of construction between adjacent louvers, a flat wall type appearance when the louvers are fully closed. In addition, the swivel shutter assembly is constructed to provide adjustable degree of shutter opening at a plurality of differently selected positions, and to provide a swivel mechanism which allows removal and replacement of individual louvers in an easy yet expedient manner.

1 Claim, 8 Drawing Figures

FIG. 1
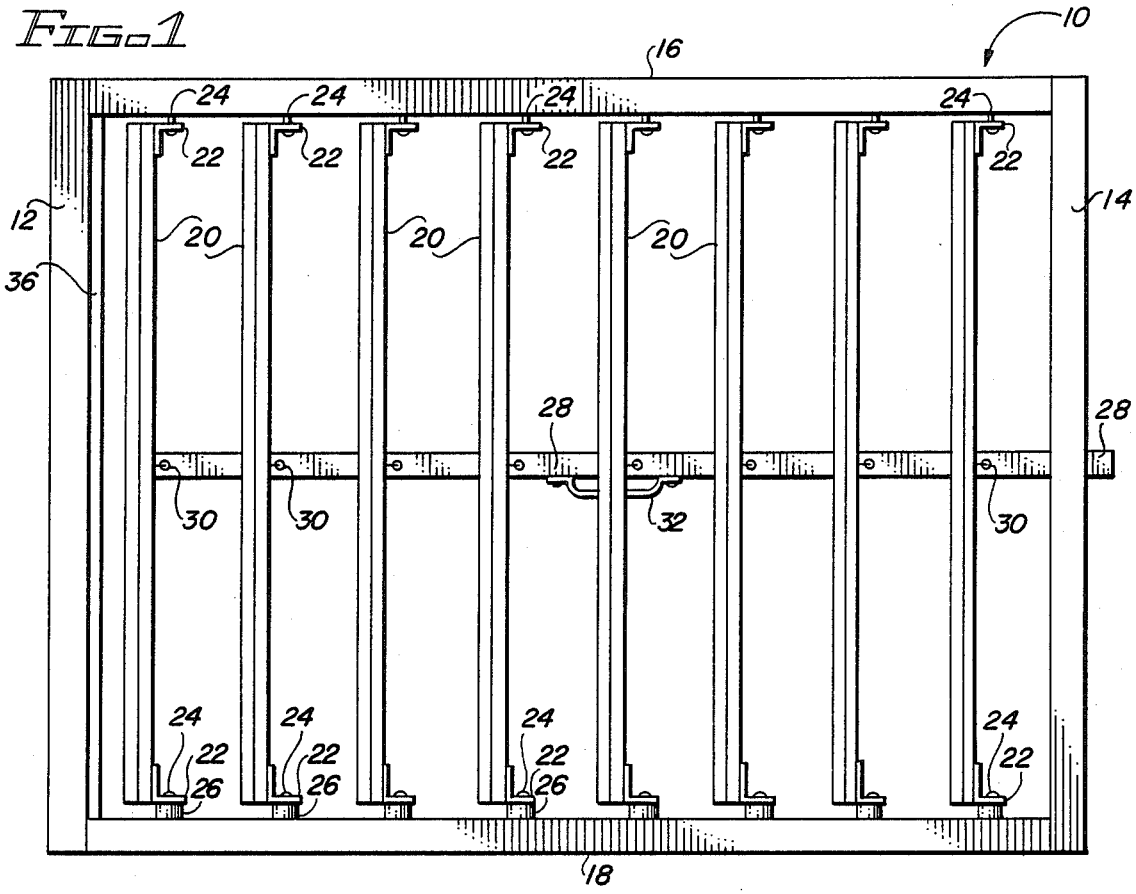
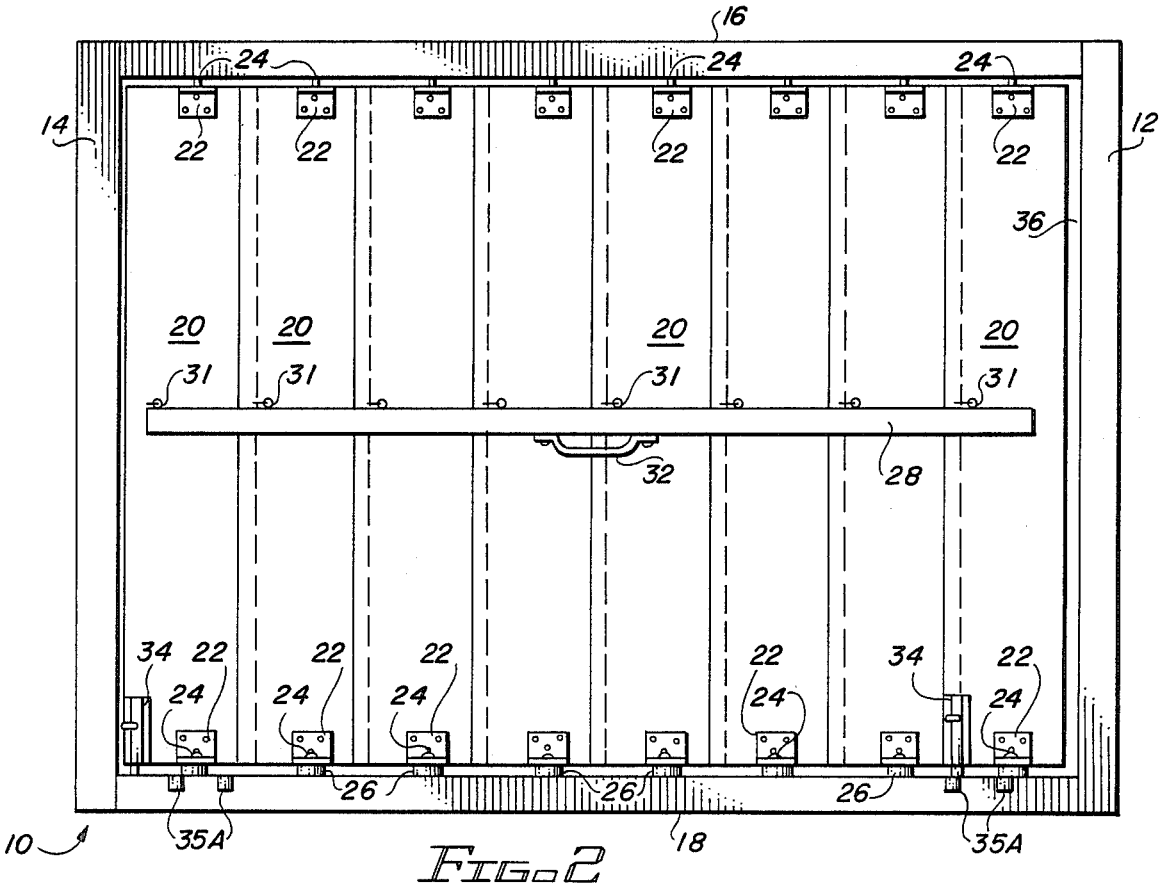
FIG. 2

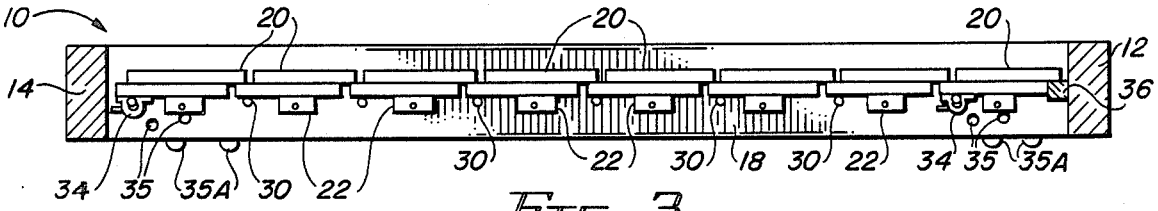
FIG. 3
FIG. 4
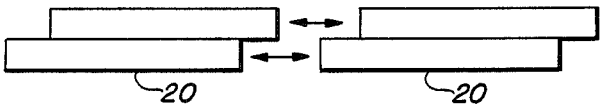
FIG. 5
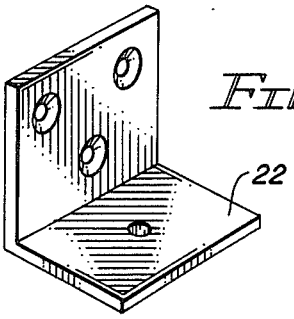
FIG. 7
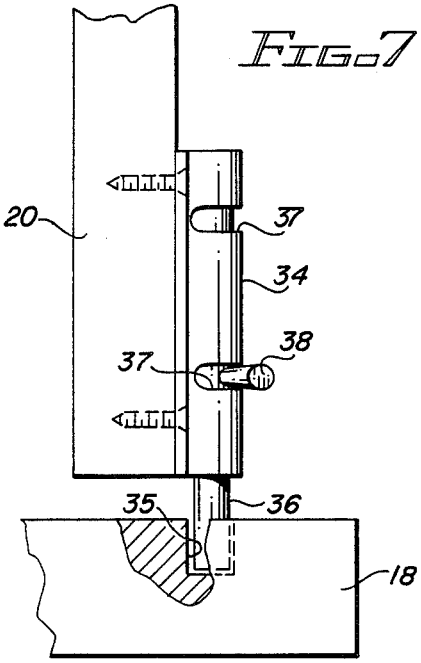
FIG. 6
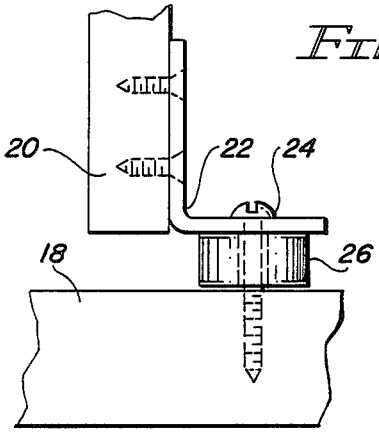
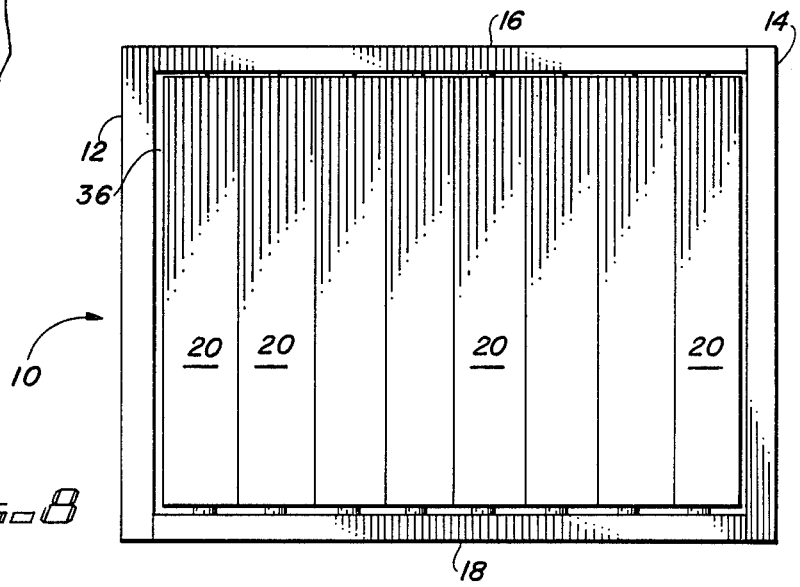
FIG. 8

SWIVEL SHUTTER ASSEMBLY

BACKGROUND OF THE INVENTION

1. Field of the Invention

The field of the invention is blind and shutter assemblies.

2. Description of Related Art

In the fields of window blinds and shutter assemblies, there has been a great deal of related art. For example, Moeller, in U.S. Pat. No. 3,137,043, discloses a wind and sun guard having a plurality of rotatable louvers or slats in a frame which are interconnected at the top and the bottom for rotation and resultant opening and closing of the multiple slats. In addition, other parties have invented variations on shutters such as the Plantbed Cover Assembly disclosed by Rowell in his U.S. Pat. No. 3,874,114, wherein the vanes, when closed, form a surpentine like surface. The vanes which constitute the surface are movable in unison to vary exposure of the plantbed.

As a further example, Pettit, in U.S. Pat. No. 2,513,250, defines a jalousie slat pivot utilizing slats which are pivotally fitted within a frame to permit opening and closing and thus allow or restrict the passage of light and wind through the frame.

All of the above examples of the prior art and all of the art known to the Inventor relating to shutters and blinds show construction that presents a non-flat surface when the slats or blinds are closed, usually an undulating surface or surface with longitudinal ridges formed by the side of one slat laying upon an adjacent side of the next slat. None of the prior art known to the Inventor shows or suggests the appearance of a wall or other flat type of surface which does not resemble a shutter assembly.

SUMMARY OF THE INVENTION

This invention relates to a swivel shutter assembly which provides the usual amenities of a shutter system, namely the characteristics of rotating or swiveling the louvers or slats from a fully closed position which presents a block to light and wind to a fully opened system which permits maximum light and wind therethrough, being only interrupted by the thickness of each louver or slat element. The Inventor presents a swivel shutter assembly wherein the shutter assembly has the added features of presenting a flat surface when closed that effectively hides the appearance of being a louvered shutter system and which does have the appearance of an attractive flat wall or similar surface. This particular attribute is accomplished by the Inventor's particular construction of the louvers or slats which comprise the swivel shutter system, and the interaction of each of the shutters or slats with their immediate neighboring slat or louver.

More specifically, the invention comprises firstly a square or rectangular frame work within which the plurality of parallel spaced apart louvers reside, each louver supported at each of its ends with means by which the louvers swivel or rotate around a point displaced from the longitudinal center of each louver, the louvers each connected to a common cross bar by means of a series of screw eyes attached to each shutter, each of which connects with a similar screw eye at spaced apart locations on the swivel bar. At the lower portion of the two outer-most oppositely situated louvers is a barrel lock assembly which, in conjunction with a plurality of blind holes in the bottom member of the square or rectangular frame, allow positioning of the louvers from a fully closed and flat configuration to a fully open configuration in a series of graduated steps.

The flat outside appearance of the swivel shutter assembly is achieved by the placing of oppositely oriented steps in the sides of each of the louvers, such that a complimentary step exists in the adjacent side of the neighboring louver in order that when the louvers are in the fully closed position, the step of one louver engages the complimentary step of the adjacent louver in a ship-lap fashion such as to form a completely flat surface over all the louvers, and by such overlapping of each louver, the passage of light or wind through the shutter assembly is prevented.

It is an object of the subject invention to provide a swivel shutter assembly in which the louvers are adjustable from a fully closed position to a fully open position in a series of graduated steps.

It is another object of the subject invention to provide a swivel shutter assembly in which the louvers may be fixedly held at a pre-selected rotational position.

It is still a further object of the subject invention to provide a swivel shutter assembly wherein the assembly, when fully closed, presents a flat surface which does not resemble a shutter assembly, but in fact resembles a wall or other flat surface.

Other objects of the invention will in part be obvious and will in part appear hereinafter. The invention accordingly comprises the apparatus comprising the construction, combination of elements, and arrangement of parts which are exemplified in the following detailed disclosure, and the scope of the Application which will be indicated.

BRIEF DESCRIPTION OF THE DRAWINGS

For further understanding of the nature and object of the present invention, reference should be had to the following detailed description taken in connection with the accompanying drawings wherein:

FIG. 1 is a front view of the subject swivel shutter assembly in an open position;

FIG. 2 is a rear view of the swivel shutter assembly in a closed position;

FIG. 3 is a top view of the subject swivel shutter assembly with the top frame member removed;

FIG. 4 is an end view of two louvers in an enlarged view and separated apart;

FIG. 5 is a perspective view of the "L" clip utilized in the swivel assembly;

FIG. 6 is a side view of the swivel mechanism at the lower end of one of the louvers;

FIG. 7 is an end view of one of the outside louvers showing the louver position locking mechanism; and FIG. 8 is a front view of the completed swivel shutter assembly in a closed position with gaps between members minimized.

In various views, like index numbers refer to like elements.

DETAILED DESCRIPTION OF THE PREFERRED EMBODIMENT

Referring firstly to FIG. 1, a front view of the subject inventive swivel shutter assembly 10 is shown with the ganged louvers opened such as to pass maximum light and wind through. Firstly, the swivel shutter assembly comprises a framework in the shape of a square or rectangle having opposite and parallel side members 12 and 14 connected at their respective tops and bottoms by opposite and parallel top member 16 and bottom member 18. All four members, which may be constructed of wood or metal, are firmly connected by nails, screws, or other attachment means to form a rigid unit. Interiorly to the square or rectangle formed by the members above recited are shown the front side of the swivel louvers or slats 20 which are permitted to swivel or pivot about a line parallel to, but off-set from the louver longitudinal center axis. This swiveling or turning of the louvers or slats is accomplished through the means of the swivel mechanism right angle "L" clips 22 which are attached to the louver 20 at each end, i.e., both the top and the bottom end of the louver, and mid-way between each of the opposite end sides, or longitudinal sides of the louver. Connecting the "L" clip 22 with the top and bottom members 16 and 18 is swivel pin 24 which resides through an opening in the portion of "L" clip 22 which is parallel to the top and bottom members, the swivel pin 24 then penetrating the respective top or bottom member to be held there. Swivel pin 24 may be a nail or wood screw if the top and bottom members 16 and 18 are constructed of wood, or a sheet metal screw or machine bolt if the top and bottom members are constructed of metal. If the top and bottom members, or either of them, are constructed of metal, obviously a threaded blind hole into such metal would be necessary for a machine bolt. If a sheet metal screw is utilized, a pilot hold may need be drilled in the top or bottom. Situated between the "L" clip 22 and the bottom member 18 is washer 26 adapted to hold the louver 20 and the "L" clip 22 above the top surface of bottom member 18 in order that the louver, when turning or swiveling, will not rub against the top surface of bottom member 18. Obviously, the above description anticipates that the swivel shutter assembly 10 will be used in an upright or vertical position with bottom member 18 at the lowermost position. In the event that it is desired that the shutter assembly should be used in any other position, i.e., laying in a flat plane, or turned upsidedown from the position shown in FIG. 1, a second washer is advised be placed on the swivel pin 24 at the top position shown in FIG. 1. By that measure, the louver 20 is spaced away from the inside surface of the top or bottom members 16 or 18 in order that as the louvers are swiveled, neither end of the louver will engage the nearby top or bottom member.

It is anticipated that the end of the louvers will be in close proximity of the top and bottom members, but not touching, in order to minimize leakage of light or wind between the louvers and the top and bottom members. To that end, washer 26 may be made very thin. FIG. 1 exaggerates the spacing between the ends of the louvers and the top and bottom members in order to illustrate the elements which make up the swivel mechanism.

Shown centrally to FIG. 1 is the swivel bar 28 which comprises an elongated bar of wood or metal and which is operably attached to each of the louvers 20 by means of screw eyes, which by horizontal movement, compels the louvers 20 to move or swivel in unison. In particular, a screw eye is attached near one side of each louver and a second screw eye is attached to swivel bar 28. Then both eyes of each of the screw eyes are interlooped so that the connection between the swivel bar 28 and the louvers 20 are made through each of a pair of screw eyes. Shown in FIG. 1 is screw eye 30 which is attached to the louvers 20. The screw eye attached to swivel bar 28 would be seen in an end view and is seen in FIG. 2.

Referring now to FIG. 2, a rear view of the swivel shutter assembly 10 showing the back side of the louvers 20 and with the louvers 20 in a closed position, i.e., with the louvers 20 laying flat, blocking off light and wind, and being in the plane formed by the four members of the frame, namely the side members 12 and 14, and top and bottom members 16 and 18 respectively. Here, substantially a full side view of each louver 20 is shown, however, there is an overlapping at each side which is later discussed. Joining each of the louvers is the swivel bar 28 with the screw eye 31 attached to the swivel bar is shown emerging from the side of the swivel bar. Attached to swivel bar 28 is handle 32 by which a person grasps to open or close the louvers, or, as later described, set them at a fixed angle. It is noted that swivel bar 28 is in its normal resting position and is rotated 90° from its position shown in FIG. 1.

Located in full view are the top and bottom "L" clips 22 which are attached to the rear outside portion of each louver, and swivel pin 24 passing through the opening in "L" clip 22 to be held firmly in the top member 16. On the lower portion of FIG. 2, the louvers, unlike the illustration in FIG. 1 which was done to show the swivel pin 24, now have the "L" clip 22 resting in their normal position upon the washer 26. Here again, the greater portion of swivel pin 24 utilized on the bottom portion which allows the louvers to swivel is not shown in FIG. 2 inasmuch as the shank of the pin is hidden by either the washer 26 or the bottom member 18 and the only part showing is the top head of swivel pin 24. Lastly, attached to one side at the bottom end of each louver nearest the side members 12 and 14 is barrel lock 34. Barrel lock 34, which is a common type lock available in hardware stores and often seen on doors, operates by having a slidable elongated circular rod which is held in a barrel shaped fitting and which, when the door is closed, slides out of the barrel fitting to engage in a blind hole in the door frame adjacent to the door itself, or to engage in a half collar mounted on the door frame. As will be explained later, a plurality of blind holes are drilled in the bottom member 18 at strategic locations in order that the louvers may be held in fixed positions from a fully closed position to a fully open position, such as at right angles to the plane of the frame or, if desired, even continued to make an angle greater than 90°. Half collars **35*a* are also shown in FIG. 2 and these are described in connection with FIG. 3**.

When the louvers 20 of swivel shutter assembly 10 are in the fully closed position, a flat attractive surface is presented which does not take the appearance of shutters with their usual undulations or ridges where one shutter lays upon its neighbor. In the present invention, with the louvers closed and with very narrow spaces between the visible edge of each louver together with narrow spacing between the ends of the louvers and the framework, practically a solid wall is portrayed.

Shown in FIG. 3 is a top view of the inventive swivel shutter assembly 10 where, for ease of illustration, top member 16 has been removed and the louvers are aligned to a closed position. In addition, swivel bar 28 has been removed as well as the screw eyes 31 which attach to swivel bar 28 and which engage the screw eyes 30 shown in the Figure. As can be plainly seen, the louvers represent unique construction wherein each of the louvers is stepped along each opposite elongated end side in order that an overlap between the next adjacent louver is achieved, i.e., each louver is stepped such as to be complimentary with its adjacent louver, and, when the louvers are in a fully closed position, completely block out light and direct passage of wind. Such construction is commonly called "ship-lap". Attached to each louver on the rearward side are the "L" clips 22, and the screw eyes 30. A top view of barrel lock 34 is also shown. Additionally shown emerging from the side of the barrel lock 34 is its handle by which its elongated circular rod is slid back and forth in its freedom of movement. Also shown in points forming a half circle, are blind holes 35 which have been drilled into lower member 18 adapted to receive the elongated circular rod of barrel lock 34 and to thereby fixedly hold the louver at a fixed adjustable angle. It is noted that there may be construction where the arc formed by the elongated circular rod of the barrel lock as the louver is rotated would cause the elongated circular rod to pass off of lower member 18. In which case, half collars 35*a* are placed upon the side edge of lower member 18 at points along the aforementioned arc to receive the elongated circular rod of the barrel lock 34 as did blind holes 35. The half collar is a part that is normally enclosed with the barrel lock when it is purchased at a hardware store and is adapted merely to receive the elongated circular rod while being attached to the side of a door jamb, for example.

Lastly, attached to side member 12 is an elongated strip of material 36, nominally of the same material as the side members, i.e., wood or metal, which serves the functions of limiting rotation of the louver 20 in order that its rotation in one direction shall be no more than to be parallel to the plane of the frame and blocking light and wind when the louvers are closed.

FIG. 4 illustrates an exploded view of two louvers which, for purposes of the drawing, have been separated to show the overlapping or ship-lapping of the stepped elongated sides of each of the louvers. In the preferred embodiment, for ease of construction, each louver is formed of two separate pieces of wood which have been lapped, one upon the other, as shown in FIG. 4. It is obvious that the louver construction may be fabricated from a single piece of wood or metal with the elongated sides stepped as shown in FIG. 4.

FIG. 5 is a perspective view of "L" clip 22 which was constructed in the preferred embodiment from a strap of galvanized steel having a right angle formed therein. For convenience in construction, three holes were punched along one leg of the "L" clip for purposes of permitting nails or screws to fasten the clip at the top and bottom end of each louver 20. Upon the other leg of "L" clip 22 is the single hole through which swivel pin 24 resides.

FIG. 6 shows an end view of the swivel connection of the lower end of louver 20 with "L" clip 22 attached to its end by means of three wood screws (two of which are shown in dotted form) and the 90° leg of "L" clip 22 being penetrated by swivel pin 24, here a wood screw. Swivel pin 24 penetrates through the center opening of washer 26 and into bottom member 18 to be firmly held thereto. In construction of the invention, swivel pin 24 is not screwed down so tightly as to restrict the rotation of "L" clip 22 upon washer 26. Additionally, as earlier mentioned, swivel pin 24 may take any one of a number of configurations, being either a wood screw as shown in FIG. 6, a flat head nail, a machine bolt if bottom member 18 is constructed from metal, or a sheet metal screw if bottom member 18 were perhaps constructed from a piece of extruded aluminum, for example.

Referring now to FIG. 7, an end view of the bottom portion of louver 20 is shown at the point of attachment of barrel lock 34. As earlier mentioned, barrel lock 34 is attached to the bottom end portion of the louvers 20 which are closest to each of the side members 14 and 16. Barrel lock 34 operates by its handle 38 attached to the elongated slidable rod 36 and moves up and down in the barrel formed in barrel lock 34. Handle 38 has two points of stopping as shown by the two notches 37 formed in the side of the barrel in which the handle 35 resides and thus lock the elongated rod 36 into an up or down position. Shown in FIG. 7 is elongated rod 36 in its down position in one of the plurality of blind holes 35 formed in bottom member 18. In operation, by means of handle 38, elongated rod 36 is moved up or down and the louver 20 held in the desired open or closed position.

Lastly, FIG. 8 details a front view of the subject inventive swivel shutter system with all louvers closed and with each louver joining its adjacent louver and the sides of the framework in a tight configuration where gaps between the sides and the top members have been reduced to a minimum. In addition, unlike FIGS. 1–3 which were drawn for purposes of illustration, the elongated side edges of the louvers have been brought together to form only a narrow gap, if any at all, between the stepped portions of adjacent louvers. Thus is obvious from the finished drawing shown in FIG. 8, the appearance of a solid wall is achieved.

Examples of construction which have been utilized in the preferred embodiment are as follows: wood 2×4's were used on the frame construction, the louvers were constructed of two 6-inch wide pieces of wood, nominally $\frac{3}{4}$-inch thick, which were lapped by 1-inch on each side, and the "L" clips were $1\frac{1}{2}$ inches wide and $2\frac{1}{4}$ inches long prior to bending. The 90° bend on the "L" clips was made $\frac{3}{4}$-inch along the longest side so that a $1\frac{1}{2}\times1\frac{1}{2}$ inch square was presented for attachment to the louver. The punched hole for the swivel pin was centered in the $\frac{3}{4}$-inch section. With the dimensions above, the swivel pins were located in holes situated 6-inches apart, and upon the center line of the top and bottom frame members. By having the swivel mechanism offset from the center of each louver, removal and replacement of any one louver for purposes of damage repair or the like is easily accomplished since each of the swivel pins are in position to be retracted from the "L" clip and the top or bottom member of the framework.

While a preferred embodiment of Applicant's invention has been shown and described, it is appreciated that such other embodiments of the invention are possible and that there is no intent to limit the invention by such disclosure, but rather it is intended to cover all modifications and alternate embodiments falling within the spirit and the scope of the invention as defined by the appended claims.

I claim:

1. A swivel shutter assembly adapted to open and close, and which presents a flat wall type appearance when closed comprising:

a framework having a lower member, a spaced apart parallel upper member, and two spaced apart parallel side members, said lower, upper, and side members forming a rectangle;

a plurality of louvers situated interiorly to said framework, each said louver having two ends, a front side, back side, opposite end sides, and a longitudinal center running centrally between each end, each said louver defining stepped portions on each of their respective end sides, each of said stepped portions adapted to be complimentary with the stepped portion of each adjacent louver when closed;

a plurality of swivel mechanisms, one of each of which operably attaching to each end of said louvers and to said framework, each said swivel mechanism including a "L"clip, one end of which attached to each end of said louvers, said other end including an opening therethrough, and further including a swivel pin adapted to reside in said opening and to be secured to each said framework upper and lower member, and further including a washer situated surrounding said swivel pin and interposed between said "L"clip and said framework upper and lower members, said swivel pin situated offset from the longitudinal center of each of said louvers and providing said louver pivotal point;

a cross bar operably attached to each louver and a handle attached to said cross bar;

a plurality of screw eyes, one of each of which attach to the back side of each louver, and one of each of which additionally attach to said cross bar, each of said screw eyes attached to said louvers interloped connected with each of said screw eyes attached to said cross bar;

a plurality of barrel lock assemblies operably attached to said louvers back side proximate said ends and said end sides, each said assembly including a slidable elongated rod, and a half collar attached to said framework lower member, said framework lower member defining a plurality of blind openings, said half collar and said blind openings adapted to receive said barrel lock assembly elongated rod to secure said louvers into a fixed open and closed position; and an elongated material strip attached to at least one of said framework side members to engage and limit movement of said louvers, whereby said louvers may be swiveled within said framework by grasping said handle to move said cross bar to open and close said louvers, and, to selectively secure the position of said louvers in said framework by manipulation of said barrel lock assembly elongated rod into one of the pluralities of blind openings and half collar and thereby allow a selected passage of light and wind through said framework.

* * * * *